US005797221A

United States Patent [19]

Young et al.

[11] Patent Number: 5,797,221

[45] Date of Patent: Aug. 25, 1998

[54] REPLACEMENT MANHOLE COVER ASSEMBLY

[76] Inventors: James E. Young, 406 Inglenook Pl.; Roy A. Meyer, 1000 Crestview Dr., both of Angola, Ind. 46703

[21] Appl. No.: 811,901

[22] Filed: Mar. 5, 1997

[51] Int. Cl.[6] ..... E02D 29/14

[52] U.S. Cl. ..... 52/20; 52/19; 52/21; 404/25; 404/26

[58] Field of Search ..... 52/19, 20, 21; 404/25, 26; 405/52

[56] References Cited

U.S. PATENT DOCUMENTS

| | | | |
|---|---|---|---|
| 4,188,151 | 2/1980 | Hall | 52/21 X |
| 4,225,266 | 9/1980 | Fier . | |
| 4,289,563 | 9/1981 | Wiechowski et al. | 156/423 |
| 4,302,126 | 11/1981 | Fier | 404/26 |
| 4,466,219 | 8/1984 | Campolito . | |
| 4,662,777 | 5/1987 | Newton . | |
| 4,673,310 | 6/1987 | Le Baron . | |
| 4,867,601 | 9/1989 | Bowman . | |
| 4,976,568 | 12/1990 | Hess | 404/26 |
| 5,044,818 | 9/1991 | Pritchard . | |
| 5,123,776 | 6/1992 | Lang et al. . | |
| 5,143,478 | 9/1992 | Bowman . | |
| 5,165,819 | 11/1992 | Bowman . | |
| 5,209,601 | 5/1993 | Odill et al. | 52/20 X |
| 5,240,346 | 8/1993 | Yin | 52/20 X |
| 5,378,078 | 1/1995 | Lewis et al. . | |
| 5,525,006 | 6/1996 | Kilman | 52/20 X |
| 5,529,431 | 6/1996 | Walsh | 52/20 X |
| 5,549,411 | 8/1996 | Hawkins . | |
| 5,564,855 | 10/1996 | Anderson . | |
| 5,595,455 | 1/1997 | Svirklys | 52/21 X |
| 5,628,152 | 5/1997 | Bowman | 404/26 X |

*Primary Examiner*—Wynn Wood Coggins
*Attorney, Agent, or Firm*—Young & Basile, P.C.

[57] ABSTRACT

A replacement manhole cover assembly for an existing manhole having a fixed frame around the periphery of the manhole, the frame having an upper horizontal lip essentially flush with the surrounding pavement and a lower horizontal shelf, wherein the replacement manhole cover assembly includes an annular skirt selectively removable on the lower horizontal shelf of the frame, the skirt having a vertical extension terminating at a lower horizontal shelf for supporting a manhole cover made of composite material.

12 Claims, 2 Drawing Sheets

REPLACEMENT MANHOLE COVER ASSEMBLY

FIELD OF THE INVENTION

The present invention relates to a manhole cover for refueling locations such as service stations, petroleum fuel depots, airports and other private transportation areas. In particular, the invention relates to a replacement manhole cover made essentially of composite material.

BACKGROUND OF THE INVENTION

Manholes are located at refueling locations to provide access to underground tanks, pumps, meters and related services for the petroleum industry. The manholes include an annular metal frame attached around the periphery of the manhole. The existing frame provides a shelf for supporting a manhole cover. The shelf has a depth such that the top of the manhole cover lies essentially on the same plane as the surrounding surface.

Traditionally, manhole covers are manufactured from steel to provide a cost effective access means to the underground services that can withstand significant loads. However, these existing manhole covers are made from materials that are extremely heavy, making access to the manhole by a single person difficult, as well as not meeting OSHA requirements. As a result, it is desirable to replace these heavy metal manhole covers with a cover design made up of both lightweight composite and steel material. Further, it is desirable to maintain the same strength and durability as the traditional metal manhole covers while continuing the flush surface of the manhole cover with the surrounding surface.

Inevitably, the thickness of a substitute resin or other lightweight composite material used for a manhole cover will necessarily need to be thicker in order to provide the same physical strength attributes of the traditional steel manhole cover. Therefore it is necessary to provide a suitable adapter to the existing frame that will provide a support for a thicker composite manhole cover.

The widely accepted criterion for United States highway traffic loading as included in *Standard Specifications for Highway Bridges* published by AASHTO (American Association of State Highway and Transportation Officials) is now being applied under federal guidelines to composite manhole covers used by the petroleum industry in service stations, petroleum fuel depots, airports, and other private transportation areas like shopping centers and convenience stores related to re-fueling location applications. In the overseas market, the European standard EN124 applies. Both of those standards define compliance for the two axle truck and the tractor trucks with a tandem axle semi-trailer loading condition. For both standards, the maximum axle load requiring support in actual practice is 32,000 pounds or 16,000 pounds for each set of dual tire wheels. The latter figure is by definition the design limit for every manhole cover manufactured in the U.S. In the case of overseas shipments, EN124 requires that manhole covers must withstand a maximum loading of 18,827 pounds for the classification that applies to manholes used in petroleum industry applications as defined above. In addition, there are two critical safety design aspects for composite manhole covers. They include strength failure and flatness failure. Strength failure is due to stresses from vehicle traffic exceeding the ultimate vertical loading strength of the composite manhole cover for any diameter and thickness. Flatness failure is the permanent "dishing" of the composite cover resulting in an unsafe rocking condition while setting in the steel rim skirt assembly.

SUMMARY OF THE INVENTION

It is the intent of the subject invention to address the aforementioned concerns by providing a manhole cover made of a composite material that is a lighter weight than the traditional steel or other metal manhole covers. In particular, it is the intent to provide a manhole cover assembly that is approximately half the weight of the current steel manhole cover. It is further an intent, of this invention to provide a composite material manhole cover that meets the aforementioned safety designs, as well as meets federal and European standards. It is additionally the intent of this invention to provide a simple and quick replacement for the metal manhole cover that can be accommodated in the existing fixed-in-place frame surrounding the periphery of the manhole that provides direct replacement for an existing steel manhole cover.

The intent is to replace the current heavy manhole covers with a more lightweight and accessible manhole cover. A thicker composite lid is used for placement over the manhole. In order to support the composite manhole cover upon the existing frame located in the manhole, an annular adjustment skirt is provided for placement over the existing frame in the manhole. The skirt includes an upper lip for placement to rest on a shelf of the existing frame in the manhole. The skirt further includes a vertical drop extension. The vertical drop extension terminates at a horizontal shelf. The length of the drop extension is sized to accommodate the increased thickness of the manhole cover by using a composite material.

The composite material manhole cover is then placed on the shelf formed by the annular skirt which allows for a greater depth to accommodate the thickness of the composite material used for the cover.

Other objects, advantages and applications of the present invention will become apparent to those skilled in the art when the following description of the best mode contemplated for practicing the invention is read in conjunction with the accompanying drawings.

DESCRIPTION OF THE PREFERRED EMBODIMENT

Figure 1:
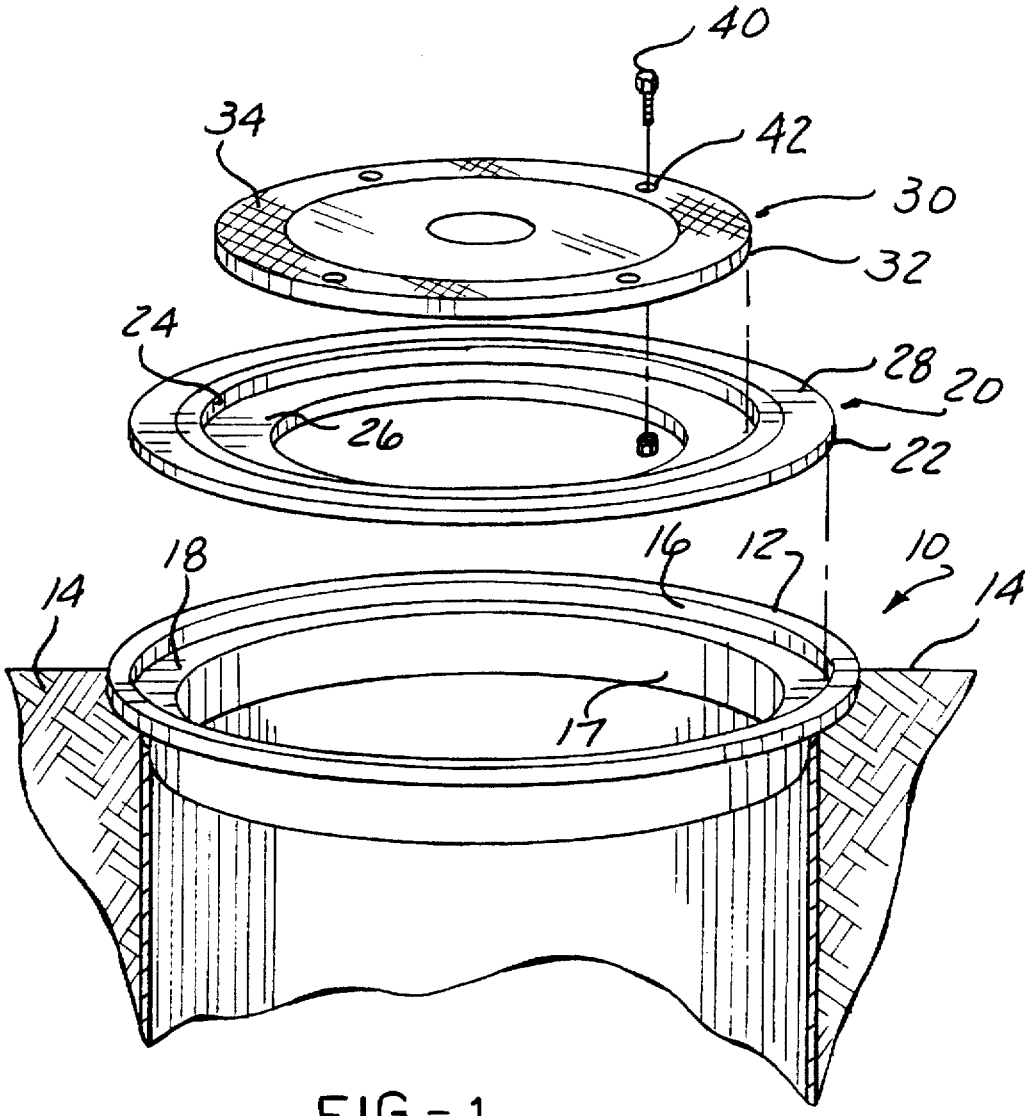
FIG. 1, is an exploded and perspective view of a replacement manhole cover according of the subject invention.
Figure 2:
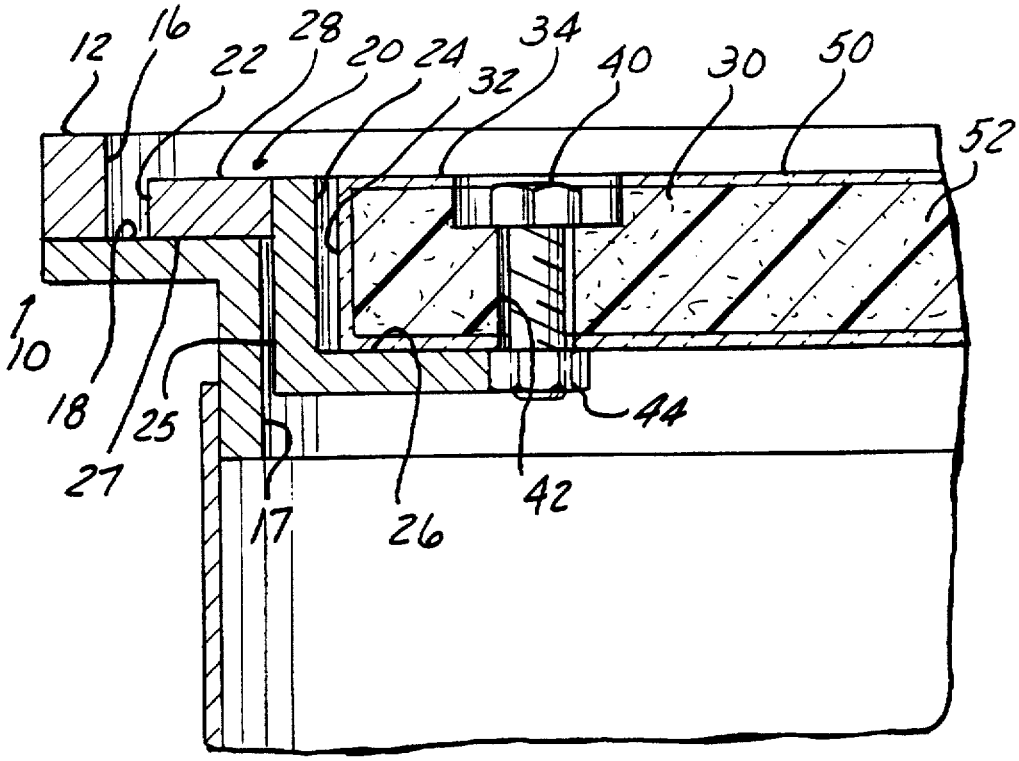
FIG. 2, is a fragmentary vertical cross-sectional view of the manhole cover.
Figure 3:
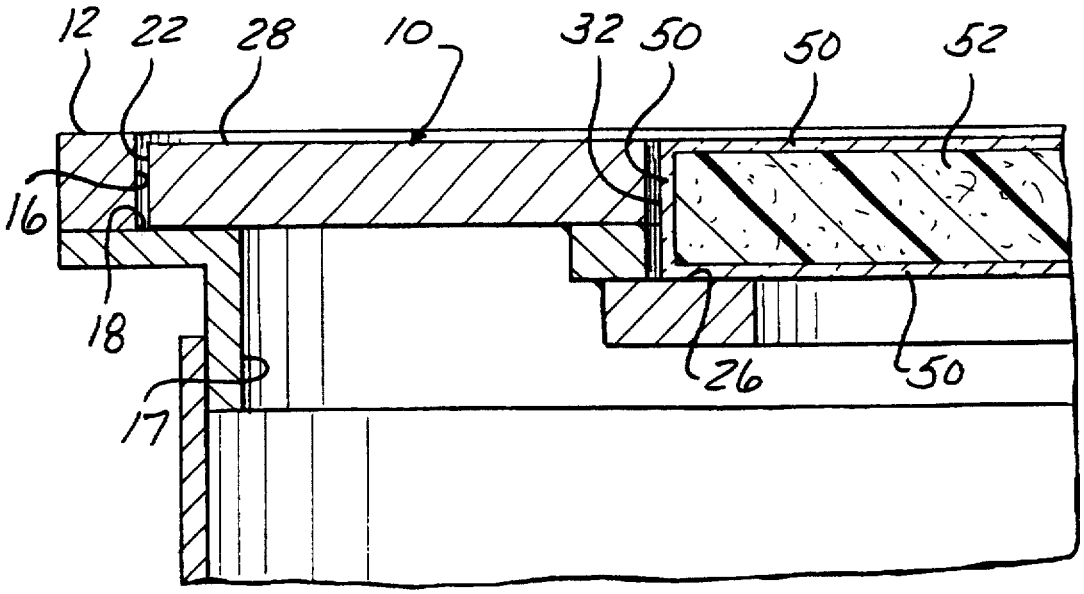
FIG. 3, is a fragmentary vertical cross-sectional view of a second embodiment of the invention.

Referring to FIGS. 1–3, an existing manhole will include a fixed-in-place annular manhole cover frame 10 that is recessed into the ground surface and held in place by suitable material such as concrete. An upper horizontal surface 12 of frame 10 is generally at the same level as the adjacent road or pavement 14. Inwardly from the horizontal surface 12 is a vertical surface 16 terminating at a second horizontal surface 18 inwardly of the first horizontal surface 12. The second horizontal surface 18 is at a location vertically lower than the upper horizontal surface 12. The second horizontal surface 18 defines a shelf upon which the existing steel manhole cover rests. The intent of this invention is to simple replace the heavy steel manhole cover with a lighter composite material manhole cover. Inevitably, in order to provide the same durability and strength in the composite manhole cover as was previously experienced in the metal manhole cover, it is necessary to provide a thicker manhole cover. The composite manhole cover 30 will be approximately one inch thick. As a result a composite manhole cover 30 providing the same specifications as the previous metal manhole cover would be raised above the surface of the surrounding roadway or pavement when placed on shelf 18. Therefore, it is necessary to lower the shelf height for placement of the composite manhole cover 30.

An annular adaptor skirt 20 is provided for placement in the manhole and on the manhole frame 10 such that the annular skirt 20 provides a lower shelf for retaining a thicker composite manhole cover 30. The annular skirt 20 includes an outer vertical surface 22 and an inner vertical surface 24. The inner vertical surface 24 terminates at an inner horizontal surface 26. The inner horizontal surface 26 defines a replacement shelf 26 located at a lower height when installed in the manhole for receiving the composite manhole cover 30. The dimension of the annular skirt 20 is such that the upper vertical surface 22 of the skirt is slidable engaged along vertical surface 16 of the existing frame 10. There is enough clearance between the vertical section 22 on the annular skirt 20 and the vertical section 16 of the existing frame 10 such that fingers or another tool may fit therebetween to lift the annular skirt away from the fixed frame 10. Looking at FIGS. 2 and 3, when the annular skirt 20 is located on the horizontal surface 18 of the existing frame 10 the upper surface 28 of the annular skirt 20 is essentially flush or slightly below that of surface 12 of frame 10 as well as the surrounding pavement 14. The vertical wall 24 of the annular skirt 20, essentially defines the depth of the replacement shelf 26 for receiving the composite manhole cover 30 so that it is not above the adjacent road 14. Another exterior horizontal surface 25 adjacent vertical wall 24 of the annular skirt 20 is received within the inner periphery 17 of the fixed frame 10. A lower surface 27 on annular skirt 20 adjacent horizontal surface 28 rests against the shelf surface 18 of the existing frame 10 to support the skirt 20.

The composite manhole cover 30 has an outer annular peripheral wall 32 that is sized to be accommodated and received within the annular vertical wall 24 and on the replacement shelf 26 of the annular skirt 20. The upper horizontal surface 34 of the composite manhole cover 30 will therefore be essentially flush with the upper horizontal surface 28 of the annular skirt 28 as well as the surrounding pavement 14.

As can be seen in FIGS. 2 and 3, the annular skirt 20 can have varying configurations. The annular skirt 20 in FIG. 2 is constructed of a 0.750 by 0.375 inch bar stock shaped to form an annular upper portion of the skirt 20. A 1.25 inch by a 1.25 by 0.25 angle bar formed to corresponding annular shape is welded to the inner surface of the first bar piece. This angle piece forms the shelf 26 for receiving the composite manhole cover 30.

In FIG. 3, a ⅝ inch thick bar stock is shaped to form the outer diameter surface of the annular skirt such that it is flushed with the surrounding roadway. A ⅜ inch bar stock is annularly configured and welded to the lower surface at the innermost periphery of the ⅝ inch bar stock. A ⅜ inch bar stock approximately 1 inch long is also formed to a corresponding annular shape and is then welded to the small ⅜ inch bar stock to form a shelf for receiving the composite manhole cover 30. Other modifications of the metal bar stock may form the skirt 20 and the shelf 36 for the composite manhole cover 30.

Figure 4:
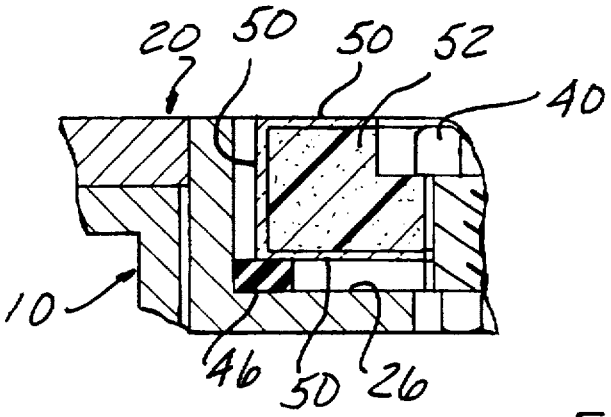
FIG. 4, is a fragmentary vertical cross-sectional view of the subject invention with a watertight feature.

FIG. 2 further shows a bolt down version of the composite manhole cover 30 which includes a threadable hex nut 40 which is received in apertures 42 through the composite manhole cover 30 and through shelf portion 26 of the annular skirt 20. The hex nut 40 then may be welded as shown at 44 to secure the composite manhole cover 30 in place. FIG. 4 further shows a modification including a watertight feature, such that a water resistant annular gasket 46 is place on the outer perimeter of the replacement shelf 26. The composite manhole cover 30 sets on the gasket 46 within the annular skirt 20.

The composite manhole cover 30 is manufactured to withstand over 30,000 pounds of loading without any cover damage. A resin transfer molding process is used for the production of the composite manhole cover 30. The process includes positioning continuous strand and woven mats of glass fiber layers 50 designed for the specific product in an open mold. A matching second half mold is mated to the first half model and clamped together. A catalyst resin 52 mix specifically designed for the composite manhole cover 30 is pumped into the cavity. The mold is allowed to cure before removing the part from the mold set.

For installation of the manhole cover assembly, the annular skirt 20 needs to be installed at grade height. The grade should run slightly downward away from the manhole location. The installation of the annular skirt 20 must include maintaining the roundness and the flatness of the assembly to insure that the composite manhole cover 30 has a proper flat and round mating surface 26 that is free of any debris. If the assembly is a bolt down or watertight configuration, then the assembly must be installed with the composite manhole cover 30 in the secured position. The hex cap screws 44 should be tighten only snug fit. Manhole covers 30 should be repositioned carefully, as marked if removed from the annular skirt 20.

To ensure competent information, impartial independent outside testing was conducted. This study's purpose for composite covers was to apply both the U.S. Federal Specification RR-F-621 (federal specification for frames, covers, gratings, steps, sump, and catch basins, manholes) and the European standard EN124 (gully tops and manhole tops for vehicular and pedestrian areas—design requirements, type testing, marking, quality control) to composite manhole covers for load rating compliance. To make certain those results could be compared worldwide to other composite manhole manufacturers, the Enneking test study included the following elements: a) covers to be tested were randomly selected from those manufactured, b) various sample sizes and configuration were tested with vertical center loading applied for a period of five minutes per load increment over the load range of interest, c) detailed material testing was performed to verify glass fiber strength, and d) high and low experimental temperature variations were investigated.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A replacement manhole cover assembly for direct installation into a manhole having a fixed annular frame secured therein, said frame having an annular first vertical member extending alone the periphery of said manhole, said vertical member having an annular upper horizontal surface at one end essentially flush with adjacent pavement, and said vertical member terminating at a lower horizontal shelf at the other end, said lower horizontal shelf having an inner diameter smaller than the diameter of the upper horizontal surface, said assembly comprising:

an annular skirt having an annular horizontal lip positionable on said lower horizontal shelf of the frame, an annular vertical drop extension attached to the horizontal lip, and a horizontal replacement shelf, wherein said vertical drop extension terminates at the horizontal replacement shelf, wherein said horizontal replacement shelf is locatable below said lower horizontal shelf of the frame; and a manhole cover made of a composite material and supported on the horizontal replacement shelf.

2. The assembly of claim 1 wherein when said manhole cover is supported by the replacement shelf, said cover is essentially flush with the adjacent pavement.

3. The assembly of claim 1, wherein said manhole cover is made of a resin material.

4. The assembly of claim 3, wherein said manhole cover has outer surfaces made of glass fiber.

5. The assembly of claim 1, wherein the height of the vertical drop extension essentially corresponds to the height of the manhole cover.

6. The assembly of claim 1, wherein said manhole cover is bolted to the horizontal replacement shelf of the annular skirt.

7. The assembly of claim 1, further comprising an annular water resistant gasket disposed between the horizontal replacement shelf and the manhole cover.

8. A replacement manhole cover assembly for direct replacement into a manhole located in the ground, the manhole having a fixed annular frame secured therein, said frame having an annular ledge spaced a predetermined depth below said ground, said assembly comprising:

an annular skirt having an annular horizontal lip positionable on said ledge, an annular vertical drop extension attached to the horizontal lip, and an annular horizontal replacement shelf, wherein the horizontal replacement shelf is locatable at a depth greater than the predetermined depth below said ground; and a manhole cover made of composite material removably supported on the horizontal replacement shelf.

9. The replacement manhole cover assembly of claim 8, wherein said manhole cover has a thickness greater than the predetermined depth.

10. The replacement manhole cover assembly of claim 8, wherein said manhole cover has a thickness generally corresponding to the locatable depth of the horizontal replacement shelf.

11. The replacement manhole cover assembly of claim 8, wherein the annular ledge of the frame has a predetermined diameter and the annular horizontal replacement shelf has a smaller diameter than the predetermined diameter of the annular ledge.

12. A replacement manhole cover assembly for direct replacement into a manhole opening through a ground surface, said manhole opening having a fixed annular frame therein, said frame having an annular upper horizontal flange extending over the periphery of the manhole opening, an attached vertical annular member extending into the manhole opening, and a lower horizontal shelf attached to the annular vertical member and spaced from the upper horizontal flanges, said assembly comprising:

an annular skirt having a first replacement shelf having a diameter, first replacement shelf placeable on said lower horizontal shelf and a second replacement shelf connected to said first replacement shelf by a vertical annular ring, wherein said second replacement shelf has a smaller diameter than the diameter of the first replacement shelf; and a manhole cover made of composite material, said manhole cover supportable on said second replacement shelf.

* * * * *